US006949888B2

(12) United States Patent
Ribarich

(10) Patent No.: US 6,949,888 B2
(45) Date of Patent: Sep. 27, 2005

(54) DIMMING BALLAST CONTROL IC WITH FLASH SUPPRESSION CIRCUIT

(75) Inventor: Thomas Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 56 days.

(21) Appl. No.: 10/760,046

(22) Filed: Jan. 15, 2004

(65) Prior Publication Data

US 2004/0174122 A1 Sep. 9, 2004

Related U.S. Application Data

(60) Provisional application No. 60/440,417, filed on Jan. 15, 2003, and provisional application No. 60/440,926, filed on Jan. 16, 2003.

(51) Int. Cl.[7] ..... G05F 1/00

(52) U.S. Cl. ..... 315/291; 315/224; 315/209 R; 315/307; 315/308; 315/DIG. 4; 315/DIG. 7

(58) Field of Search ..... 315/224, 291, 315/307, 308, 244, 194, 209 R, DIG. 4, DIG. 7; 363/98; 361/18; 307/39

(56) References Cited

U.S. PATENT DOCUMENTS 3,890,537 A 6/1975 Park et al. ..... 315/208
3,913,002 A 10/1975 Steigerwald et al. ..... 363/18
4,240,009 A 12/1980 Paul ..... 315/224
5,680,017 A * 10/1997 Veldman et al. ..... 315/308
6,008,593 A 12/1999 Ribarich ..... 315/307
6,011,360 A 1/2000 Gradzki et al. ..... 315/244
6,211,623 B1 * 4/2001 Wilhelm et al. ..... 315/224

* cited by examiner

*Primary Examiner*—Haissa Philogene
(74) *Attorney, Agent, or Firm*—Ostrolenk, Faber, Gerb & Soffen, LLP

(57) ABSTRACT

A dimming electronic ballast control provides flash suppression by igniting the fluorescent lamp at a high power level, and then reducing the power output level to the appropriate dimming set level. The electronic ballast includes an integrated circuit that uses closed loop phase control and a VCO to control a switching frequency of a half bridge, which in turn controls power delivered to the fluorescent lamp. Current through the half bridge is sensed to provide closed loop control. The current sense signal is used to provide a high power level in the electronic ballast during ignition of the lamp, and as a phase detector for the phase control. A rate of change control circuit controls the speed of adjustment between power level settings, especially during ignition of the lamp. The electronic ballast provides a wide linear dimming range with fault detection and flash suppression.

9 Claims, 12 Drawing Sheets

DIMMING BALLAST CONTROL IC WITH FLASH SUPPRESSION CIRCUIT

RELATED APPLICATION

The present application is based on and claims benefit of U.S. Provisional Application No. 60/440,926, filed Jan. 16, 2003, entitled Dimming Ballast Control IC with Flash Suppression Circuit, to which a claim of priority is hereby made, and which is incorporated in its entirety herein by reference.

BACKGROUND OF THE INVENTION

1. Field of the Invention

The present invention relates generally to electronic ballasts for fluorescent lamps, and relates more particularly to electronic ballast controls that can prevent fluorescent light flashes.

2. Description of the Prior Art

Electronic ballasts for fluorescent lamps are well known, particularly those that operate with a switching half bridge. Such an electronic ballast is illustrated in U.S. Pat. No. 6,008,593 to International Rectifier Corporation. Electronic ballast controls have evolved to include dimming functions, and in particular substantially linear dimming control. One type of dimming control is illustrated in U.S. Pat. No. 6,008,593 to International Rectifier Corporation.

When fluorescent lamps are operated in a dimmed mode, the electronic ballast can cause problems during ignition of the fluorescent lamp at startup. During startup, the electronic ballast produces a high voltage to ignite the lamp. In the type of situation where a low light level is selected and the lamp is ignited, an undesirable flash across the lamp can occur because the time it takes for he lamp to first ignite at the maximum brightness level ant then transition to the final low dimming level is noticeable to the human eye. For this reason, it would be advantageous to prevent the fluorescent lamp from flashing during ignition and running.

SUMMARY OF THE INVENTION

In accordance with the present invention, lamp flash is prevented by reducing the transition time from maximum brightness to the final low dimming level. The reduction in transition time gives the lamp the appearance of starting cleanly and smoothly, directly at the desired dimming level. The present invention provides an electronic ballast control for a fluorescent lamp that detects ignition of the lamp. The control method detects ignition at the earliest available time and closes the loop so that the system can transition to the minimum dimming setting before the human eye can detect a flash. The circuit measures the peak output current against an upper threshold as the current increases during the ignition ramp. When the peak current exceeds the upper threshold, the threshold is then decreased to a lower threshold. When the lamp ignites, the current decreases below the lower threshold and the circuit closes the dimming loop. The current supplied through the electronic ballast drops to the reduced power level threshold, the dimming control is active with a closed loop control.

Also, the lamp can extinguish during rapid changes in dimming levels. The present invention provides an electronic ballast control with a rate attenuation control for dimming changes to prevent lamp from extinguishing.

BRIEF DESCRIPTION OF THE DRAWINGS

The invention is described below in greater detail with reference to the accompanying drawings in which.

DETAILED DESCRIPTION OF THE PREFERRED EMBODIMENTS

Figure 1:
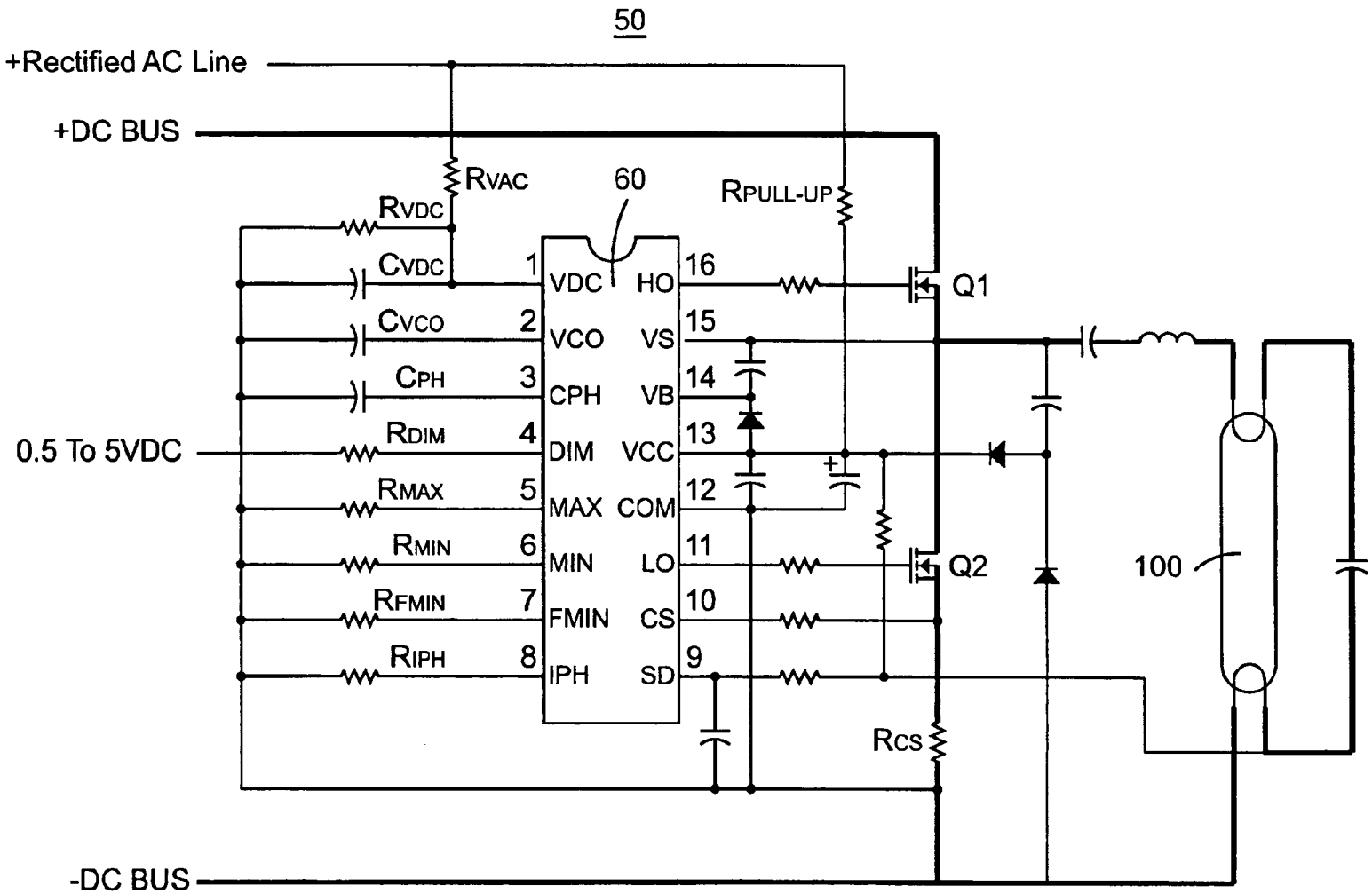
FIG. 1 is a circuit diagram of an exemplary electronic ballast with the dimming ballast control according to the present invention.

The present invention provides an improvement to a dimming electronic ballast controlled to prevent lamp flash. Referring now to FIG. 1, a typical circuit arrangement for an electronic ballast is illustrated as circuit 50. A fluorescent lamp 100 is operated by the electronic ballast based on input settings and parameter selection. The electronic ballast operates with a half bridge composed of two switches including a high side switch Q1 and a low side switch Q2. Switches Q1 and Q2 are operated by electronic ballast control IC 60 in accordance with the input command and parameter settings provided by external components on control IC 60. Control IC 60 provides a ballast control and a half bridge driver in a single IC, and is capable of sensing lamp power without the use of a current transformer. Control IC 60 provides closed loop lamp power control and preheat current control, the preheat time and current being programmable by external components. A lamp ignition detection feature is also provided by control IC 60, along with a programmable time for adjusting the power ramp from ignition to dimming set level. An input DIM of control IC 60 receives a 0.5 to 5 volt DC dimming control input to set the light level output controlled by control IC 60. Control IC 60 is made to be flexible for use with a number of types of fluorescent lamps, and so provides minimum and maximum lamp power adjustments, as well as a programmable minimum frequency to adjust the range of operation for the selected lamp 100. An input CS to control IC 60 is obtained from a low side switch in the switching half bridge to determine current supplied to lamp 100. The current sense signal is taken as a voltage signal derived from the gate-to-drain resistance of the low side switch Q2, for example.

Control IC 60 is designed to work with high power switches Q1 and Q2 that are capable of withstanding voltages in the range of 600 volts. The phase control provided by control IC 60 obtains a nearly linear dimming control throughout the range of dimming values and obtains a closed loop control with lamp power sensing to eliminate the need of a current transformer. The closed loop current control contributes to minimizing changes to components that may be needed in existing ballasts when control IC 60 is used to replace an electronic ballast control to provide a dimming feature. Control IC 60 also realizes a number of fault detection features including failure to ignite, filament failure, thermal overload, lamp failure during normal operation and power supply faults including undervoltage. An automatic restart function is also included in control IC 60 to permit the lamp to be reignited in the case of a low voltage condition in the power supply.

Figure 2:
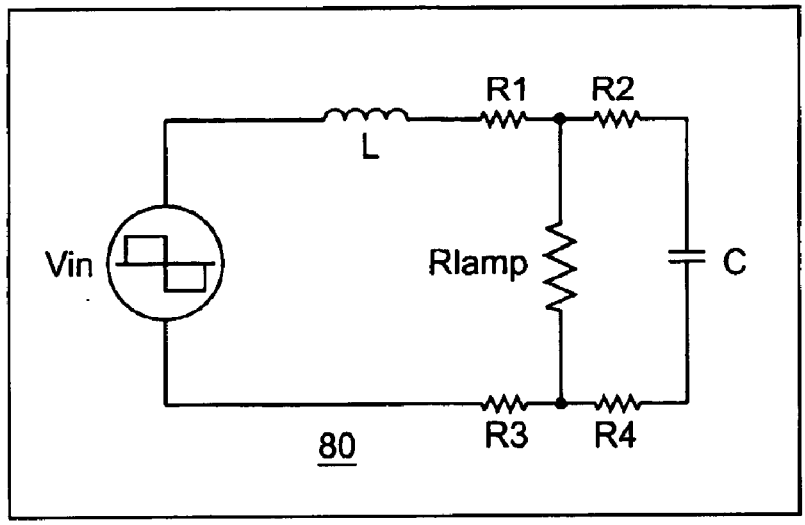
FIG. 2 is a simplified model of the ballast output stage.
Figure 3:
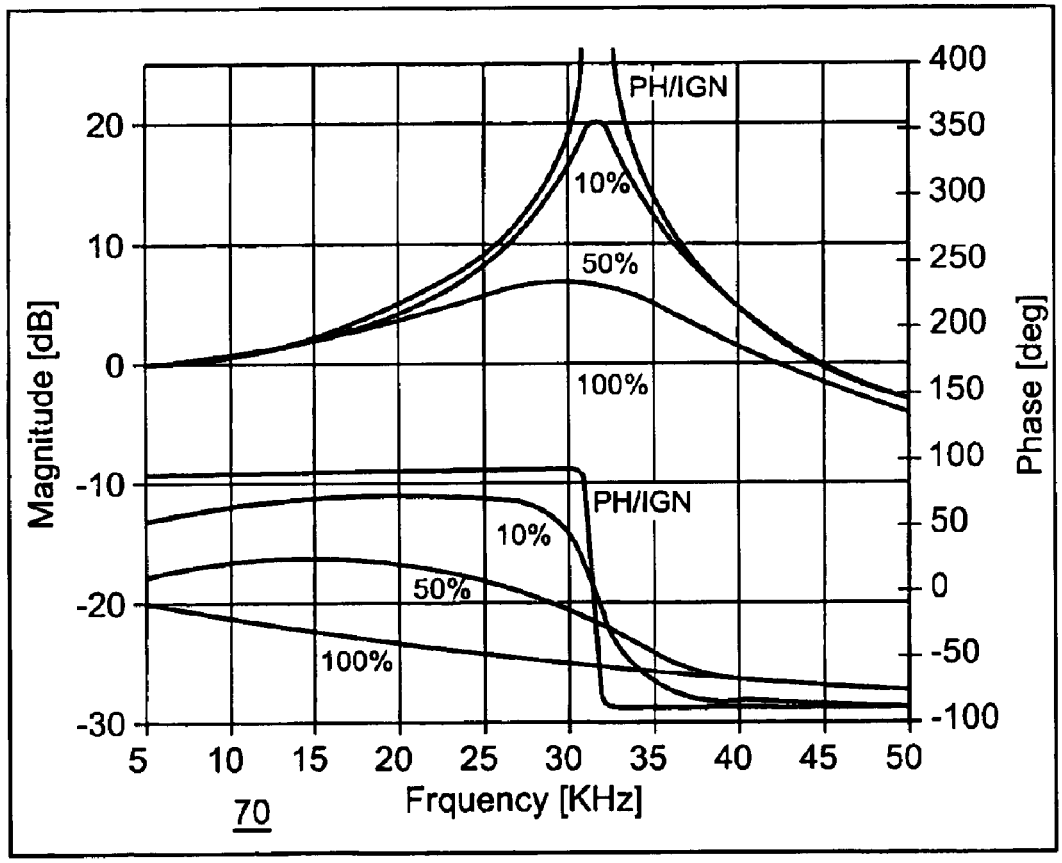
FIG. 3 is a graph illustrating output stage transfer function responses for different lamp power levels in the electronic ballast.

Referring now to FIGS. 2 and 3, a simplified circuit for illustrating operation of the output stage of the fluorescent lamp electronic ballast is illustrated as circuit 80. Chart 70 in FIG. 3 illustrates the transfer function characteristics of model circuit 80 at different operating modes and power levels. The ballast output stage is modeled as inductor L, capacitor C and a resistor network composed of filament resistors R1–R4 and lamp resistor Rlamp. During preheat and ignition circuit 80 is a high-Q series LC with a strong input current to input voltage phase inversion from +90 to −90° at the resonance frequency. For operating frequencies slightly above resonance and higher, the phase if fixed at −90° during preheat and ignition modes. During dimming or run mode, circuit 80 is modeled as an inductor L in series with a parallel RC combination, with a weak phase inversion at high lamp power and a strong phase inversion at low lamp power.

Figure 4:
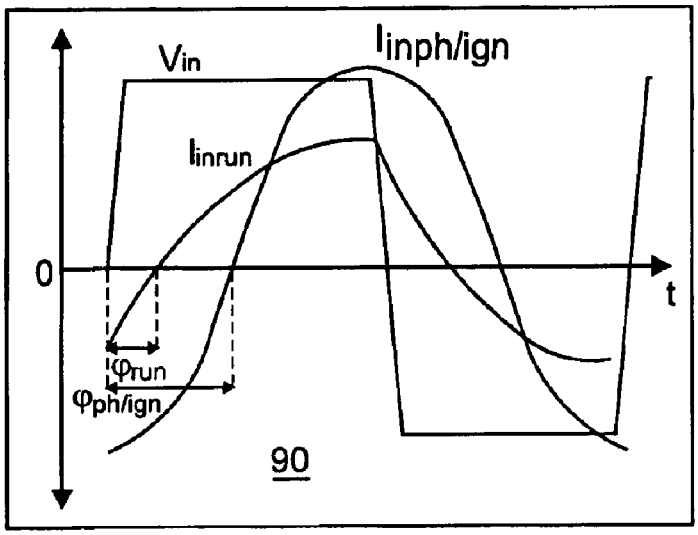
FIG. 4 is a graph showing electronic ballast output stage waveforms as a function of time.
Figure 5:
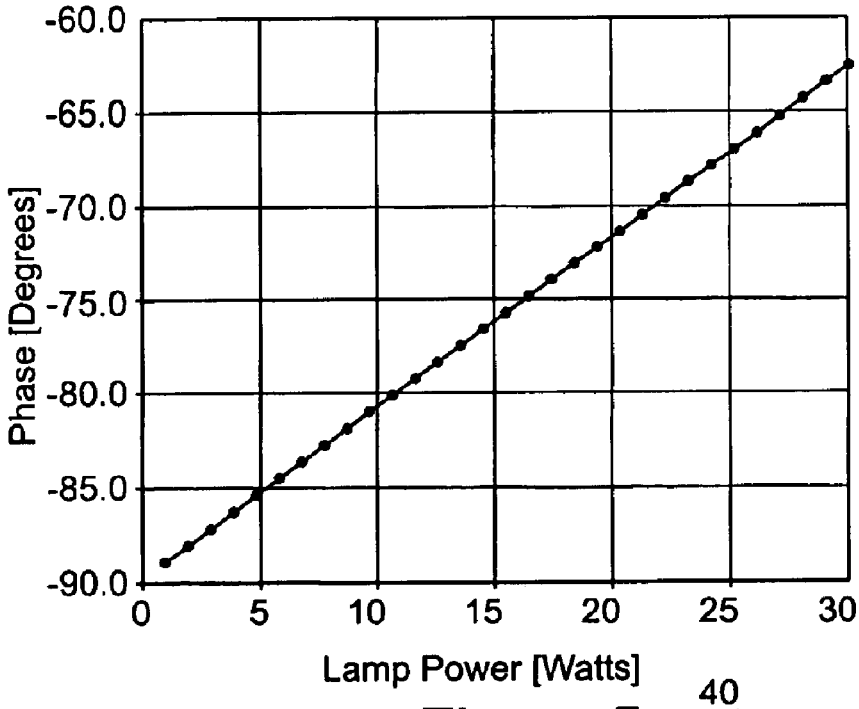
FIG. 5 is a plot of lamp power versus phase shift for the electronic ballast output stage.

Referring now to FIG. 4, the phase shift of the input current is illustrated in the time domain in graph 90. Graph 90 shows the input current shifted −90° from the input half bridge voltage during preheat and ignition, and between zero and −90° after ignition and during normal running. In the phase control of control IC 60, zero phase shift corresponds to maximum power. The phase adjustment versus lamp power is plotted in graph 40 in FIG. 5. As can be seen from graph 40, the relationship between phase difference and lamp power is very linear over the entire range of dimming operation, even down in the extremely low light levels of operation where the resistance of the lamp can change by orders of magnitude as a function of supplied power.

Figure 6:
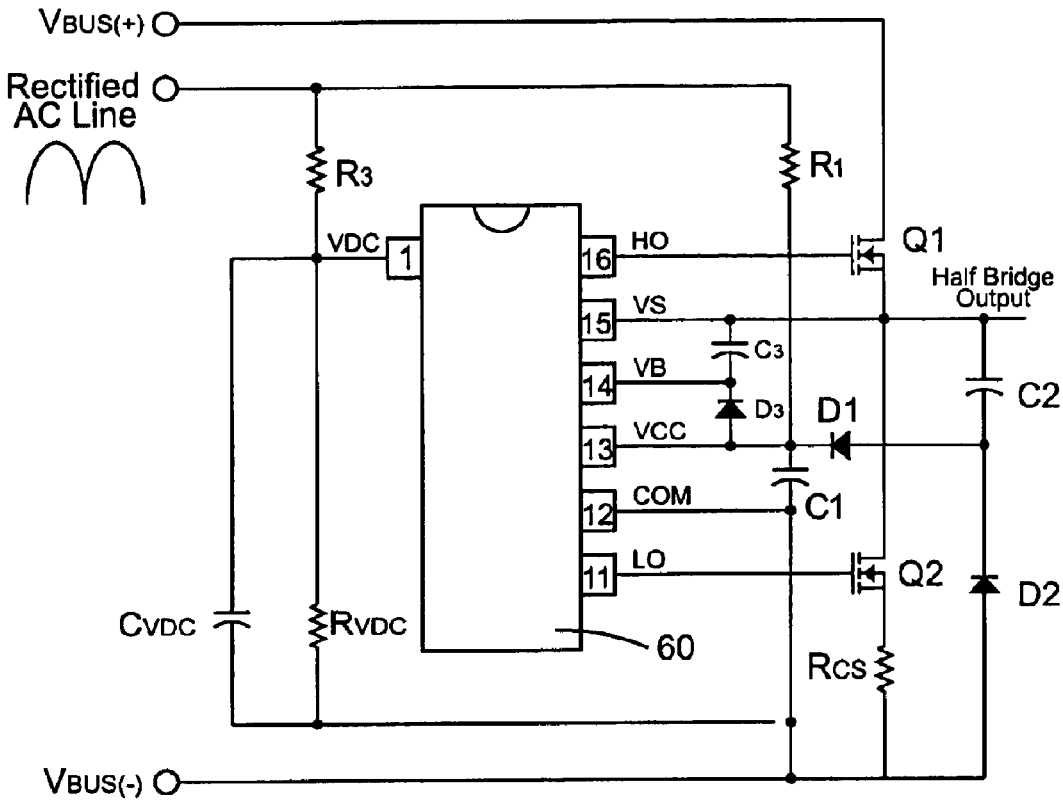
FIG. 6 is a circuit diagram illustrating startup circuitry components for the electronic lamp ballast.

Referring now to FIG. 6, a circuit diagram showing a portion of the components of circuit 50 is illustrated to show operation of the electronic ballast in undervoltage lockout mode (UVLO). Undervoltage lockout provides a preventative measure for protecting switches Q1 and Q2 in an undervoltage condition. Typically, during startup, drive voltage is rising but not sufficient to properly activate the output drivers of control IC 60 and insure proper operation of switches Q1 and Q2. Accordingly, the high and low side output drivers for switches Q1 and Q2, respectively, are not activated until control IC 60 is fully functional with an appropriate power supply level. At the same time, an ultra low quiescent current of less than 200 micro amps is maintained by control IC 60 on pin VCC. Circuit 30 includes a charge pump in the electronic ballast output stage composed of resistor R1, capacitors C1 and C2 and diodes D1 and D2. Circuit 30 obtains an efficient startup supply by using the startup current supplied by control IC 60 together with the electronic ballast output stage components in the charge pump.

Startup capacitor C1 charges with current supplied through resistor R1, which is partially reduced by the startup current drawn by control IC 60. Resistor R1 is chosen to provide approximately two times a maximum startup current at low line voltage levels to obtain suitable operation under worse case input power conditions. Control IC 60 turns on after the voltage on capacitor C1 reaches a startup threshold and the voltage on pin VDC of control IC 60 is about 5.1 volts. The condition of the voltage on pin VDC is to provide brownout protection as described in greater detail below. Once control IC 60 turns on, driver outputs HO and LO begin to oscillate to drive the electronic ballast. As drive outputs HO and LO begin to oscillate, control IC 60 draws more current and startup capacitor C1 begins to discharge due to the extra current draw.

Figure 7:
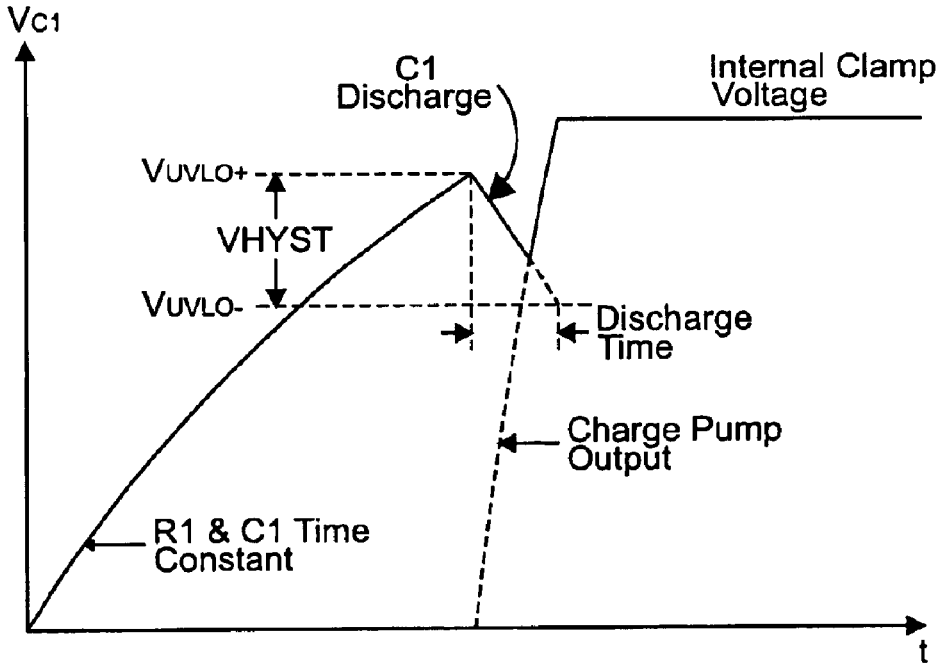
FIG. 7 is a plot of startup capacitor voltage versus time.

Referring now to FIG. 7, as capacitor C1 begins to discharge the voltage supplied by the charge pump begins to contribute rectified current to charge capacitor C1 above the operating threshold voltage for control IC 60. As the charge output increases, it serves as the supply voltage in combination with a 15.6 volt zener clamp that is internal to control IC 60. Startup capacitor C1 and snubber capacitor C2 are chosen to provide good startup functionality even in worst case IC conditions. A boot strap diode D3 and supply capacitor C3 contribute to delivering the supply voltage for the high side driver circuitry. Preferably, the high side supply is charged up before the first driver output pulse on driver output HO. Accordingly, the first pulse supplied by control IC to the switching half bridge is on driver output LO to begin driving the switch oscillation on switch Q2. During UVLO mode, the high and low side driver outputs HO and LO are maintained at a low level, while pin VCO of control IC 60 (FIG. 1) is internally pulled up to 5 volts, which resets the starting frequency of the electronic ballast to the high level of the range. Also during startup, pin CPH is internally connected to COM in control IC 60, which serves to reset the preheat time for preheating the filaments of lamp 100.

Control IC 60 also provides brownout protection by conditioning the oscillation of the output drivers on several input voltage conditions. In addition to the voltage on pin VCC being above the startup threshold, pin VDC of control IC 60 is checked for a voltage level of above 5.1 volts to permit oscillation of the driver outputs. A voltage divider composed of resistor R3 and resistor RVDC connected to the rectified AC line input provides programmable voltage levels for brownout protection thresholds. The voltage divider connected to pin VDC measures the rectified AC line input voltage to the electronic ballast, while providing a programmed turn-on and turn-off level for line voltage levels. A filter capacitor CVDC is connected to pin VDC to contribute to reducing ripple voltage to a level that is suitably low, while preventing the lower turnoff threshold of 3 volts, for example, from being reached during normal line conditions. Capacitor CVDC contributes to preventing lamp 100 from extinguishing during low line level conditions before control IC 60 is properly reset. If a brownout condition occurs, the DC bus can drop to a voltage level below a low threshold that is used by the tank circuit to maintain an appropriate lamp voltage. The brownout protection circuit permits the electronic ballast to achieve a clean turn off of lamp 100 before the DC bus drops to a low value that resets control IC 60 to the preheat mode to obtain an appropriate restart when the line voltage returns to its appropriate value.

Figure 8:
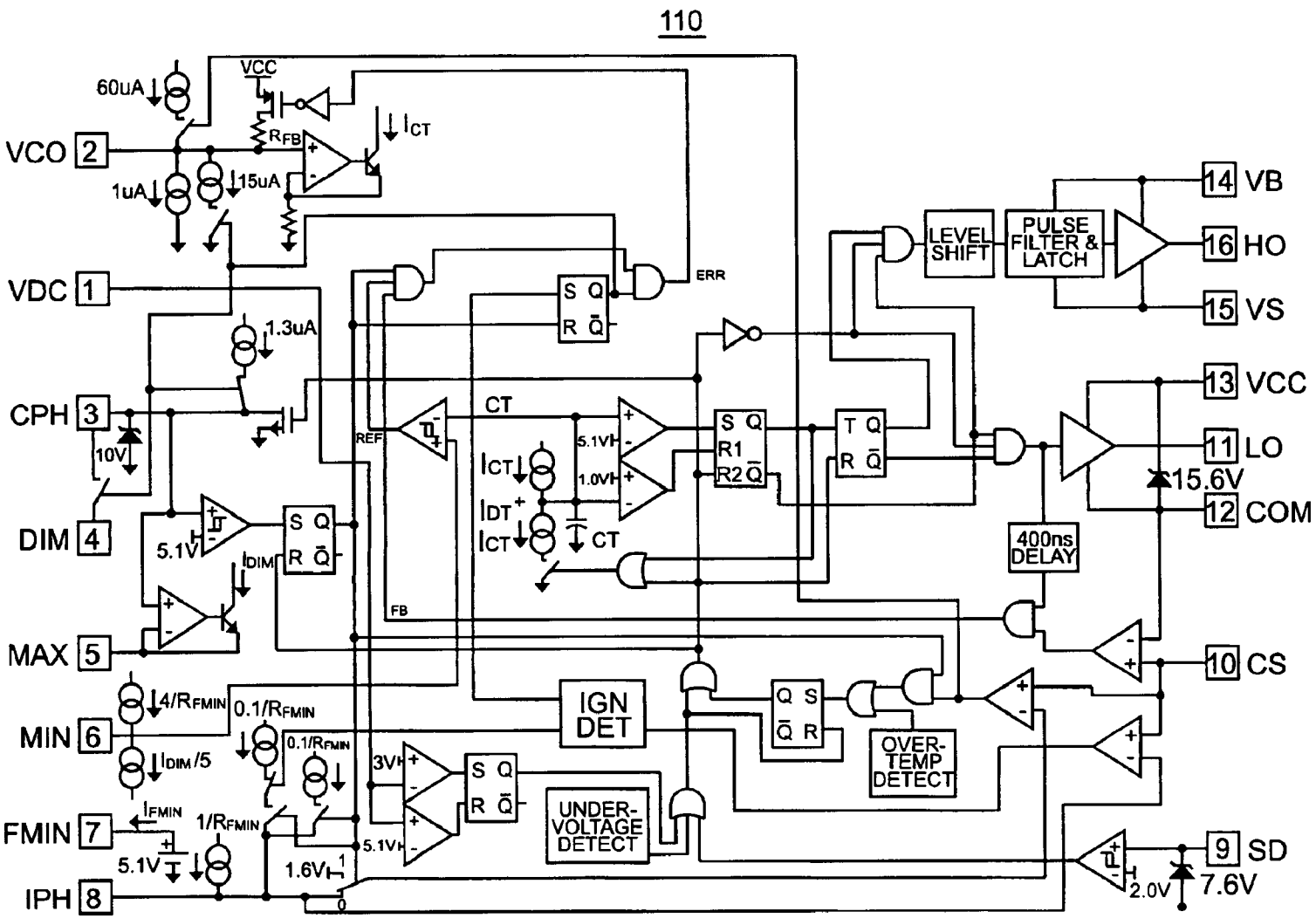
FIG. 8 is a circuit block diagram illustrating the internal structure of the electronic ballast control.

Referring now to FIG. 8, a block diagram of the internal structure of control IC 60 is illustrated generally as circuit 110. As illustrated in circuit 110, control IC 60 provides oscillating driver outputs HO and LO based on a voltage control oscillator that is driven by a signal supplied on pin VCO. Inputs are provided for preheat parameter selection, as well as minimum and maximum values for the range of electronic ballast operations. Circuit 110 also illustrates fault detection features including undervoltage, overtemperature, overcurrent and so forth, that combine to provide an error signal ERR while also providing a feature for shutting off driver outputs HO and LO.

Figure 9:
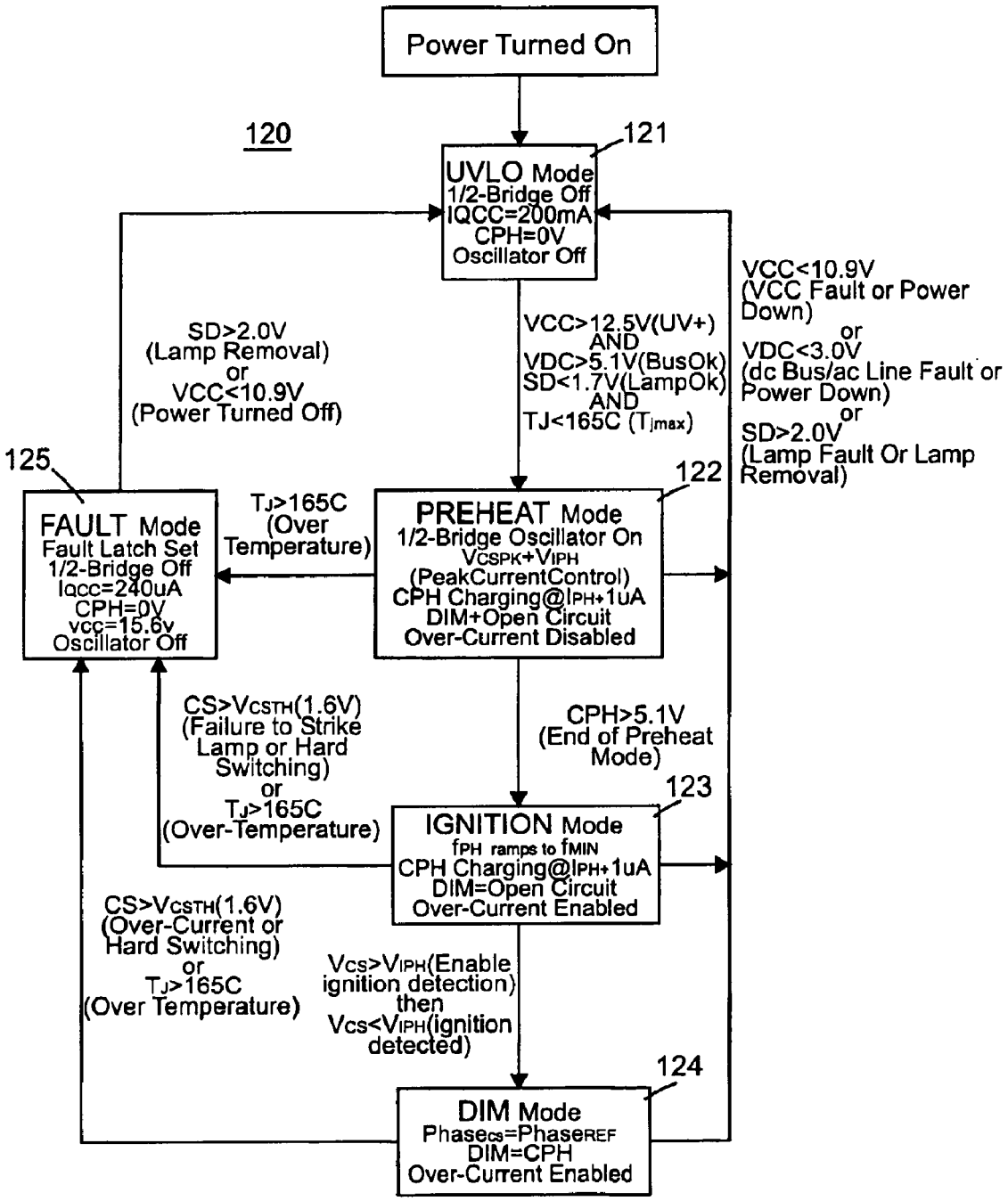
FIG. 9 is a state diagram of the operation of the electronic ballast control.

Referring to FIG. 9, a state diagram 120 illustrates operation of electronic ballast control IC 60, beginning with power supplied to the electronic ballast being turned on. As power begins to flow to the electronic ballast, control IC 60 is placed in UVLO mode in state 121. In UVLO mode, the switching half bridge is prevented from operating while a current is supplied by VCC to begin charging startup capacitor C1. Preheat capacitor CPH is set to zero volts and the oscillator function supplied by the VCO in control IC 60 is turned off. Control IC 60 continues in state 121 until certain conditions are met, including the supply voltage reaching a predetermined threshold of greater than 12.5 volts, for example, the bus supply voltage reaching a value greater than 5.1 volts, for example, a shutdown fault detection signal being less than 1.7 volts to indicate the status of lamp 100 as appropriate, for example, and the temperature of control IC 60 is appropriate, i.e., TJ is less than 165° C., for example.

Once the above conditions are met, control IC 60 proceeds to state 122 and enters preheat mode operation. During preheat mode, the switching half bridge is turned on and begins to oscillate to supply power to the filaments of lamp 100. Peak current control is established through voltage values VCSPK and VIPH to prevent large currents. Capacitor CPH charges and determines the duration of preheat time, while the dimming features and overcurrent fault detection is disabled.

Preheat mode ends when capacitor CPH charges to above 5.1 volts, for example, and control IC 60 operation moves to state 123 and begins ignition mode. During ignition mode, the high frequency of oscillation used during startup begins to ramp downward to increase the power supplied to lamp 100. During state 123, the dimming function is placed in an open circuit condition to obtain the flash suppression feature of the present invention, and overcurrent fault detection is enabled. At this point, the electronic ballast is attempting to ignite lamp 100 where VCS is increased above an increased value of VIPH to enable ignition at a high power level. Once voltage VCS increases above the increased value of VIPH, VIPH is reduced to a value under which VCS will be considered to be normal in run mode. Once ignition is detected, VCS drops down to be less than VIPH at the reduced value, and control IC 60 exits ignition mode to go into normal run mode.

Normal run mode, or dimmer mode, in state 124 is the normal state of operation for the electronic ballast and lamp 100 when the system is operating properly. In this state, the phase control is operated to drive the switching half bridge to a desired switching rate and power level based on a reference phase value. The dimming control operation is enabled and set to an appropriate value based on an input signal and a ramp to the desired value from an initial startup state. In this mode, all the fault detection features are enabled, including overcurrent direction, and the electronic ballast operates normally.

During any of the startup states 121–124, faults can be detected and an appropriate response can be maintained to prevent damage to the electronic ballast and lamp 100. For example, during startup an output stage power fault in the electronic ballast causes the electronic ballast to return to UVLO mode state 121. In addition, a DC bus or AC line power fault or loss of power results in the return to state 121 where control IC 60 is placed in UVLO mode. In addition, a lamp fault or missing lamp is determined based on the value of pin SD becoming greater than 2.0 volts, for example, and control IC 60 returns to state 121 and UVLO mode.

Faults that may occur during different stages of the startup process are also handled in a fault mode in state 125. When control IC 60 is in any of states 122–124, an overtemperature fault is provided to transition operation to state 125. In either of states 123 or 124, a hard switching fault is provided when the current sense is greater than a given threshold and the control transitions to state 125. During ignition mode in state 123, a failure to ignite the lamp also results in a transition to state 125. In dimming mode in state 124, an overcurrent fault is detected that causes a transition to fault mode state 125. Fault mode state 125 sets the electronic ballast into a failsafe type condition and sets a fault latch that is reset with lamp removal or power cycling. In this mode, the switching half bridge is turned off and a low quiescent current output of approximately 240 microamps is provided in the output supply stage. The preheat capacitor is discharged to zero to reset the preheat time, while the supply voltage is maintained at approximately 15.6 volts and the oscillator is turned off. Transition out of fault mode state 125 returns operation of control IC to UVLO mode state 121 to reinitiate a startup procedure.

Figure 10:
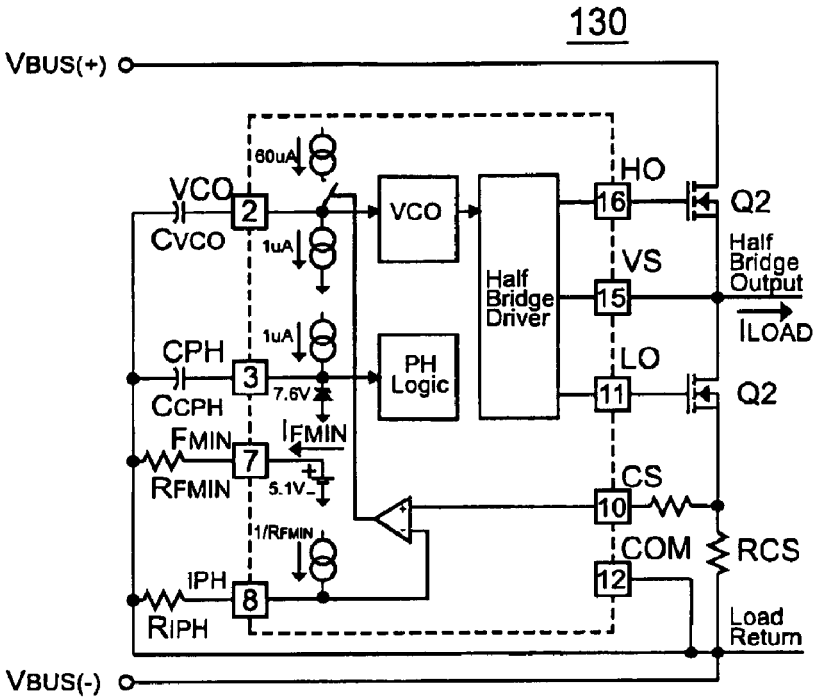
FIG. 10 is a partial circuit diagram showing the components involved in preheat operation of the electronic ballast.
Figure 11:
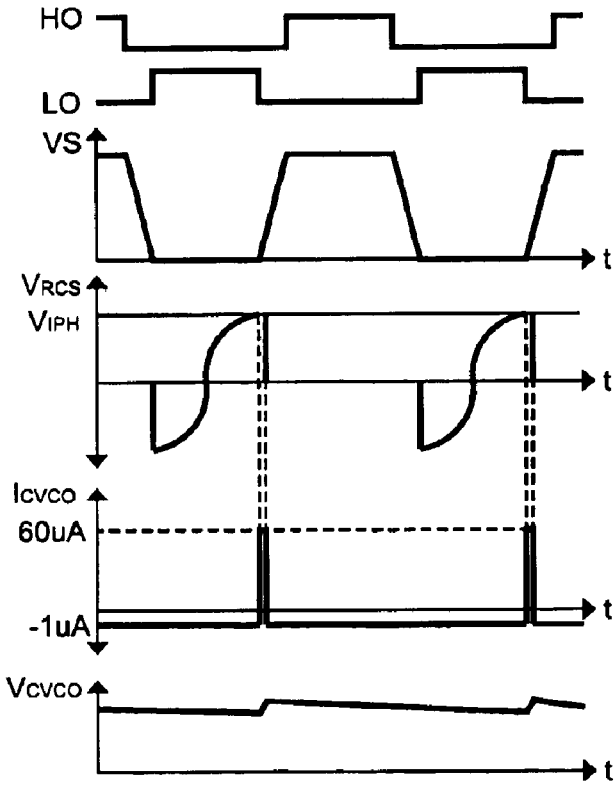
FIG. 11 is a set of waveforms illustrating preheat operation for the electronic ballast.

Referring to FIG. 10, a more detailed explanation of the preheat circuitry and operation is provided with reference to a preheat circuit diagram 130. Control IC 60 enters preheat mode when voltage VCC exceeds the UVLO+ threshold and voltage VDC exceeds 5.1 volts. In this preheat mode, driver outputs HO and LO begin to oscillate in the high range of the operating frequency with a 50% duty cycle and an internally set dead time of approximately 2 $\mu$m. Pin CPH is internally disconnected from COM and an internal 1 $\mu$A current source charges the external timing capacitor CCPH that is connected on pin CPH. Capacitor CCPH charges linearly to obtain the preheat duration time for preheating the filaments of lamp 100. Also during preheating, an internal 1 $\mu$A current source slowly discharges external capacitor CVCO on pin VCO to decrease the voltage applied on pin VCO. By decreasing the voltage on pin VCO, the oscillator frequency decreases towards resonance, thereby increasing the load current. The peak voltage measured on pin CS related to load current increases as load current flows through external sense resistor RCS. When the peak voltage on pin CS exceeds the voltage level on pin IPH, a 60 $\mu$A internal current source is connected to pin VCO and capacitor CVCO begins to discharge. These operations are reflected in the waveforms of FIG. 8 illustrating VRCS, ICVCO and VCVCO plotted against time.

When the 60 μA internal current source is connected to pin VCO to charge capacitor CVCO, the voltage on pin VCO increases. As the voltage on pin VCO increases, the frequency increases, resulting in a reduced load current. As load current measured as a voltage on pin CS decreases, and as the voltage falls below the voltage on pin IPH, the 60 μA current source is again disconnected. Disconnecting the 60 μA current source again causes the frequency of oscillation to decrease, thereby again increasing load current. This cyclic operation continues during preheat mode to heat the filaments of lamp 100. The feedback obtained through the current sense on pin CS keeps the peak preheat current regulated to the user programmed setting on pin IPH for the duration of the preheat time. An internal current source connected to external resistor RIPH sets a voltage reference for the peak preheat current. The duration of the preheat time is set to the amount of time capacitor CCPH takes to charge to above 5 volts.

Figure 12:
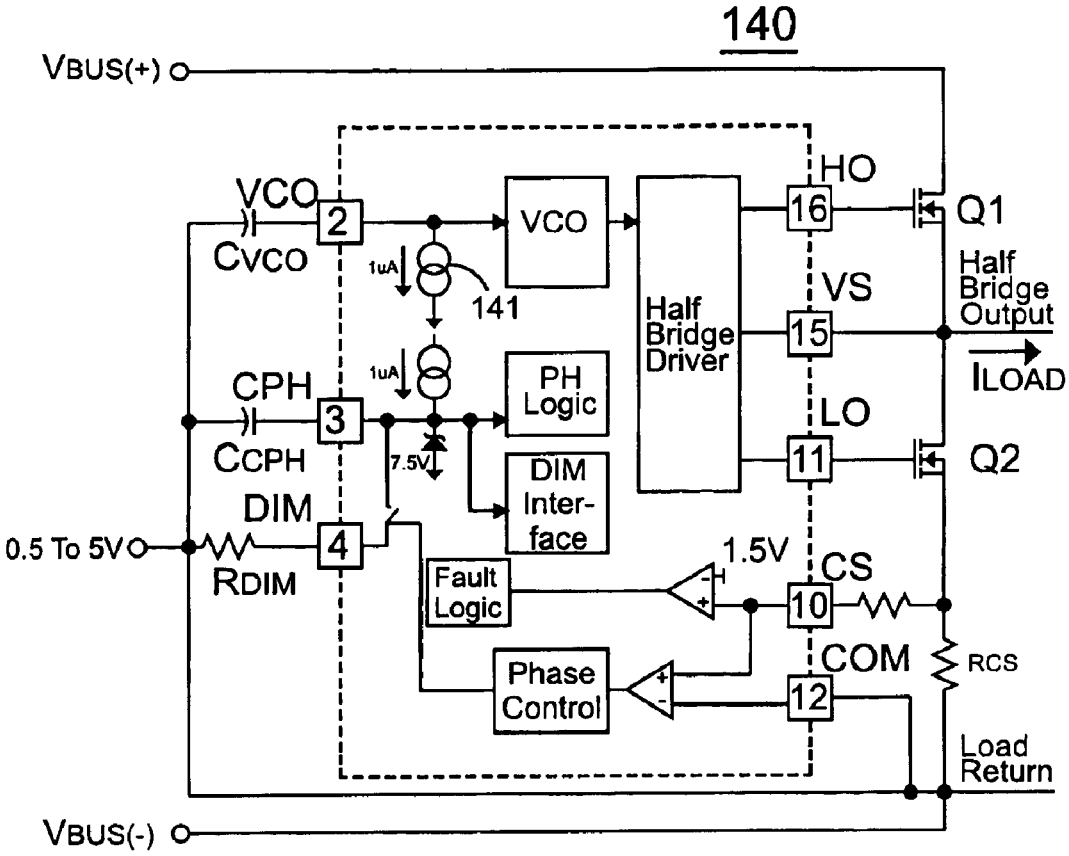
FIG. 12 is a partial circuit diagram illustrating components involved in lamp ignition circuitry.
Figure 13:
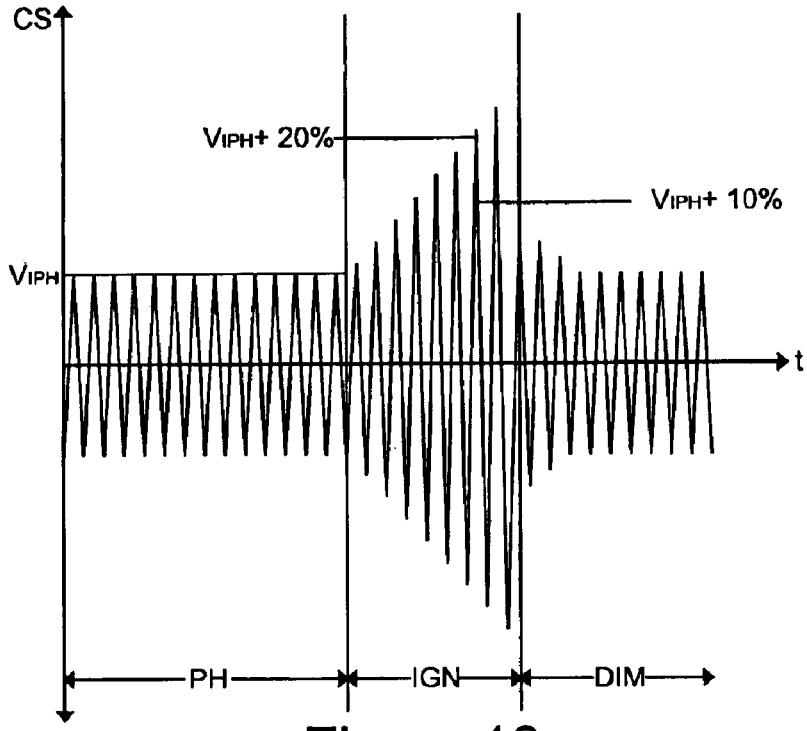
FIG. 13 is a graph illustrating electronic ballast current in different phases of operation.

Referring now to FIG. 12, a simplified circuit diagram 140 is illustrated for ignition operation of the electronic ballast. In circuit 140, ignition mode begins when the voltage on pin CPH exceeds 5 volts. The voltage supplied on pin IPH is disconnected from external resistor RIPH and instead connected to a higher internal threshold of 1.6 volts to maintain an appropriate response based on the current sense value on pin CS (see FIG. 8). An ignition frequency ramp is initiated as capacitor CVCO discharges linearly through an internal 1 μA current source 141. As the frequency decreases linearly towards the resonance frequency of the high-Q ballast output stage, the lamp voltage and lamp current increase. Referring for a moment to FIG. 13, a graphical illustration of the increasing power supplied to the lamp is shown, as reflected by the current sense voltage measurement on pin CS.

The switching frequency of the electronic ballast continues to decrease until lamp 100 ignites or the current limit is reached, causing a fault which puts control IC 60 into fault mode. The peak current limit is determined by the 1.6 volt threshold and the external current sensing resistor RCS connected through a small resistance to pin CS. This threshold sets the maximum desired peak ignition current, and consequently the maximum peak ignition voltage, for the ballast output stage. The selection of the voltage threshold and the current sense resistor RCS are made to prevent the peak ignition current from exceeding the current ratings of the output stage switches Q1 and Q2. In addition, the values are chosen to prevent the resonant inductor (FIGS. 1 and 2) from saturating at any time during operation of the electronic ballast.

When the electronic ballast control IC 60 is set to a low dimming level, it is possible to cause a flash across the lamp during the ignition of the lamp. This flash can occur due to the time it takes to transition from the maximum brightness level after ignition to the low brightness dimming setting. To prevent this flash, an ignition detection circuit measures the voltage on pin CS and compares it to the voltage on pin IPH. During ignition, as the frequency is ramping downward to increase current and voltage supplied to the lamp, circuitry in control IC 60 increases the voltage on pin IPH to approximately 20% above the voltage value set during preheat mode. As the voltage on pin CS increases, it eventually exceeds the 20% increased voltage on pin IPH. At that point, the voltage on pin IPH is decreased to approximately 10% above the preheat set point voltage, at which point the ignition detection circuit is made active. FIG. 13 illustrates the voltage on pin CS related to typical values on pin IPH, with an additional 20% or 10% indicated.

Once lamp 100 ignites, the voltage on pin CS falls below the voltage on pin IPH because of the changing characteristic of the load circuit including lamp 100. Once the voltage on pin CS decreases below the voltage on pin IPH, control IC 60 enters dimming mode and the phase control loop is made active in closed loop mode. During ignition, the voltage on pin CS is made to rise above the voltage on pin IPH, increased by an additional 20% so that the ignition detection circuit can function properly. Once the lamp ignites, the voltage on pin CS decreases to a value below the voltage on in IPH increased by 10% and control IC 60 properly enters dimming mode.

Upon entering dimming mode, control IC 60 operates in phase control mode with closed loop control to regulate the phase of the load current based on the control input on pin DIM. The phase control with the VCO modifies lamp power in accordance with the control input to obtain an appropriate dimming level while maintaining high efficiency. If the control input makes a rapid significant change, the phase control loop can respond faster to the input than the lamp is able to because of its physical properties. The result of these rapid control changes can cause the VCO to overshoot, resulting in a frequency dip below a minimum set value, thereby extinguishing the lamp.

Figure 14:
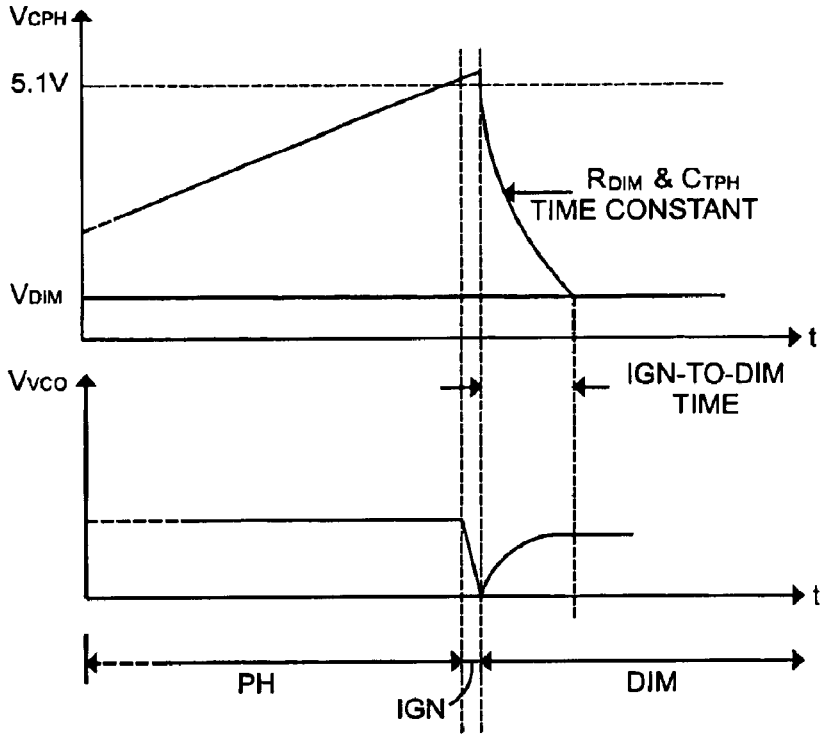
FIG. 14 is a graph showing lamp ignition and transition to running mode voltage levels as a function of time.

To prevent this problem, the rate at which dimming settings can change is controlled by control IC 60. When control IC 60 enters dimming mode, pin DIM is connected internally to pin CPH to discharge capacitor CCPH connected to pin CPH. Resistor RDIM connected to pin DIM controls the rate of discharge of capacitor CCPH as voltage VCPH decreases to the input control setting level. Accordingly, the rate of change from maximum brightness to the input dimming set level is programmably controlled. Resistor RDIM can be selected for a fast time constant to minimize the amount of flash visible over the lamp just after ignition. Alternatively, RDIM can be selected for a long time constant so that the brightness of lamp 100 ramps down smoothly to the input dimming set level. Accordingly, capacitor CCPH on pin CPH provides multiple functions by setting preheat time, rate of change for transition to dimming mode and also provides a filter function on pin DIM during dimming to increase high frequency noise immunity. By providing one capacitor to serve all these functions, component count is significantly reduced. FIG. 14 illustrates the rate of change for moving from the ignition power level to the dimming set level.

Figure 15:
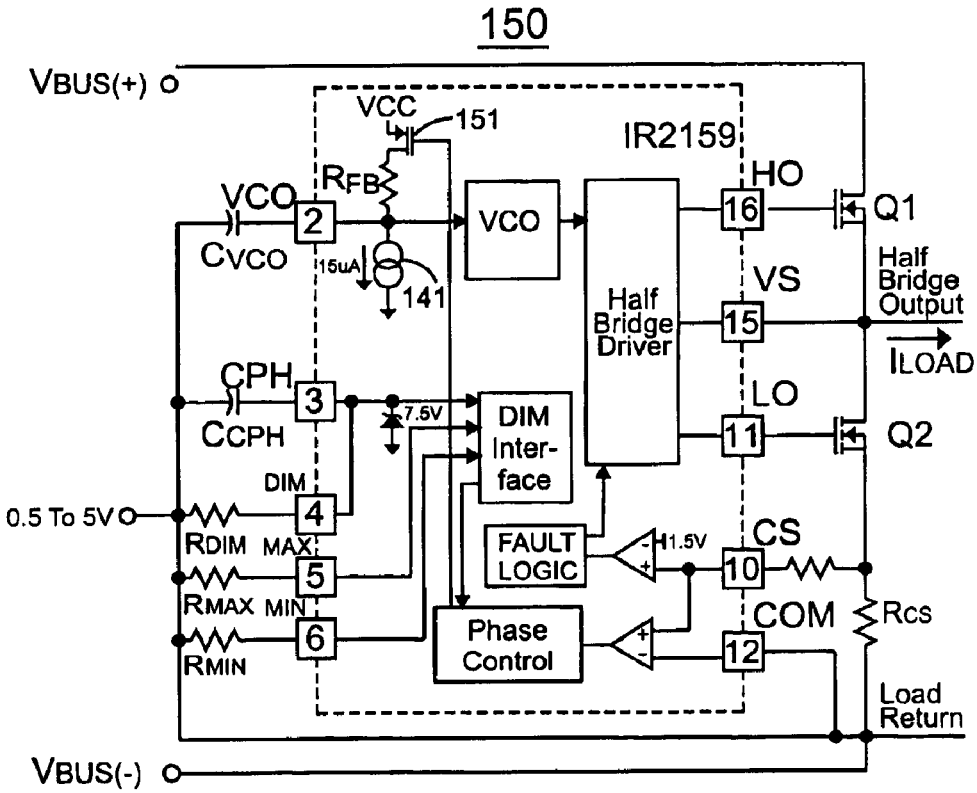
FIG. 15 is a partial circuit diagram illustrating components involved in dimming circuitry operation for the electronic ballast.
Figure 16:
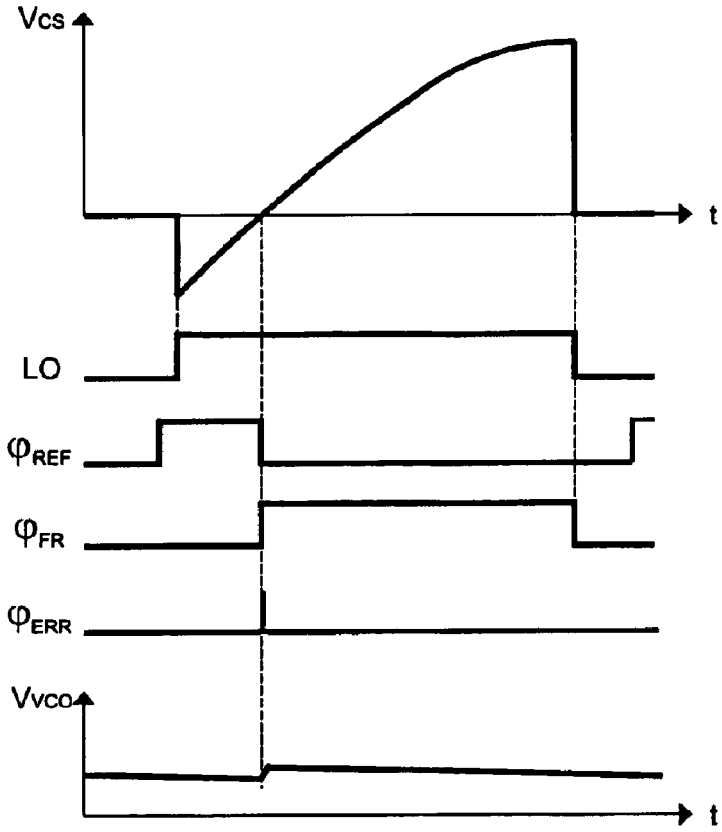
FIG. 16 is a set of waveforms illustrating phase control operation in the electronic ballast control.

When control IC 60 enters dimming mode, a closed loop phase control is implemented to regulate lamp power. The phase of the output stage current is detected and compared against a reference phase to generate an error value. The error value is used to modify operation of the VCO to modify the frequency and change the phase to force the error value to zero. Referring now to FIG. 15, an internal 15 microamp current source is connected to pin VCO during dimming mode to discharge capacitor CVCO and decrease the frequency until the phase control can lock onto the phase. Once a phase lock is achieved, the phase detector outputs short pulses to an open drain PMOS switch 151 to charge capacitor CVCO through internal resistor RFB. Referring for a moment to FIG. 16, the pulses are generated each time an error pulse occurs, indicated as VERR. This pulsing action slightly influences the integrator at the input of the VCO to maintain the phase of the output stage current locked in phase with the reference.

An input dimming control on pin DIM with a range of from 0.5 to 5 volts provides a dimming interface for analog lamp power control. The 5 volts DC corresponds to a minimum phase shift, resulting in maximum lamp power. The output of the dimming interface is provided as a voltage on pin MIN, which is compared to the voltage on internal timing capacitor CT (FIG. 8) to produce a frequency-independent digital reference phase.

Figure 17:
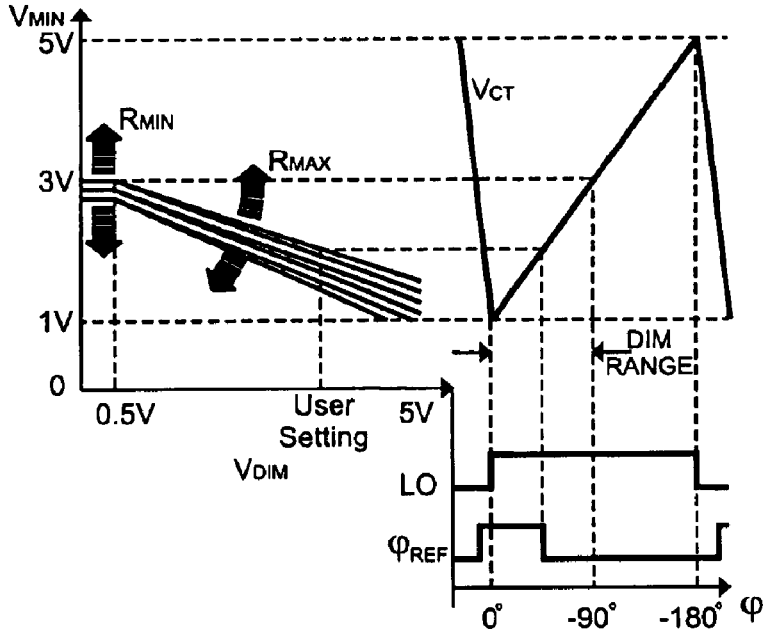
FIG. 17 is a set of waveforms illustrating dimming settings relating to switching operation.

Referring now to FIG. 17, an illustration of the relationship between the programmed resistances, the voltage on the timing capacitor and the reference phase is illustrated. The charging time of capacitor CT from 1 volt to 5.1 volts determines the on time of output gate drivers HO and LO, and corresponds to −180° of possible phase shift in load current, absent switching dead time. For the zero to −90° dimming range, the voltage on pin MIN is bounded between 1 volt and 3 volts using pins MIN and MAX. An external resistor RMAX on pin MAX programs the minimum phase shift reference, or maximum lamp power, which corresponds to 5 volts input dimming set level on pin DIM. An external resistor RMIN on pin MIN sets the maximum phase shift or minimum lamp power, which corresponds to the low level of the dimming range of 0.5 volts on pin DIM.

Figure 18:
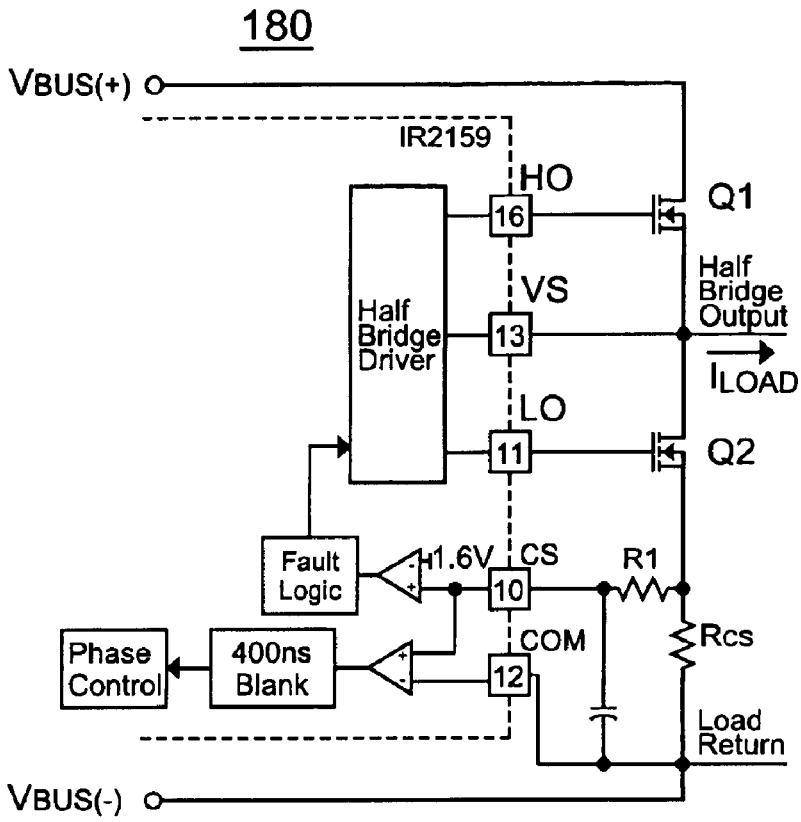
FIG. 18 is a partial circuit diagram of electronic ballast components related to current sensing circuitry.
Figure 19:
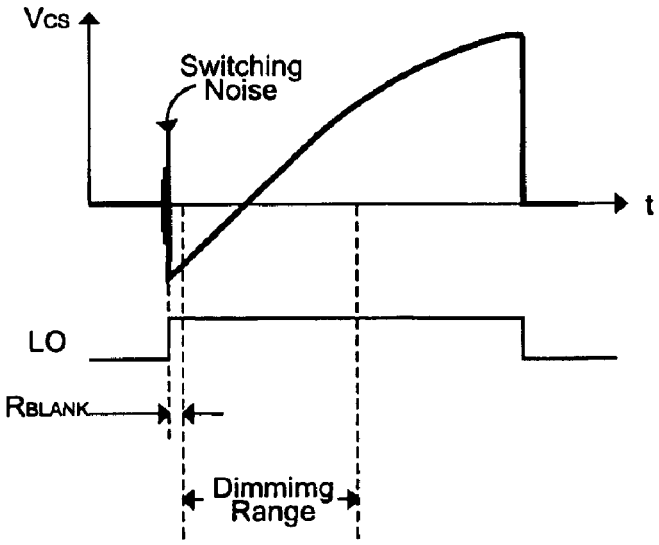
FIG. 19 is a set of waveforms illustrating current sensing timing in the electronic ballast control.

Referring now to FIG. 18, a circuit diagram 180 illustrates a portion of the electronic ballast related to current sense circuitry. During dimming mode, the current sense circuitry detects overcurrent situations that can occur during hard switching, and also detects zero crossings to measure the phase of the total load current. A digital current sense blanking circuit blanks out the sense signal from the zero crossing detection comparator for 400 nanoseconds after drive signal LO goes high to reject any switching noise which can occur at the turn on of low side switch Q2. The internal blinking time of 400 nanoseconds reduces the dimming range slightly, as indicated in FIG. 19, when operating at minimum phase shift corresponding to maximum lamp power. External programming resistor RMAX on pin MAX is selected to provide a minimum phase shift value with a safe margin from the blanking time. A series resistor R1 limits the amount of current flowing out of pin CS when the voltage across current sense resistor RCS goes below −0.7 volts. A filter capacitor on pin CS may be used to reduced other possible asynchronous noise source interference that may exist in the ballast system.

Figure 20:
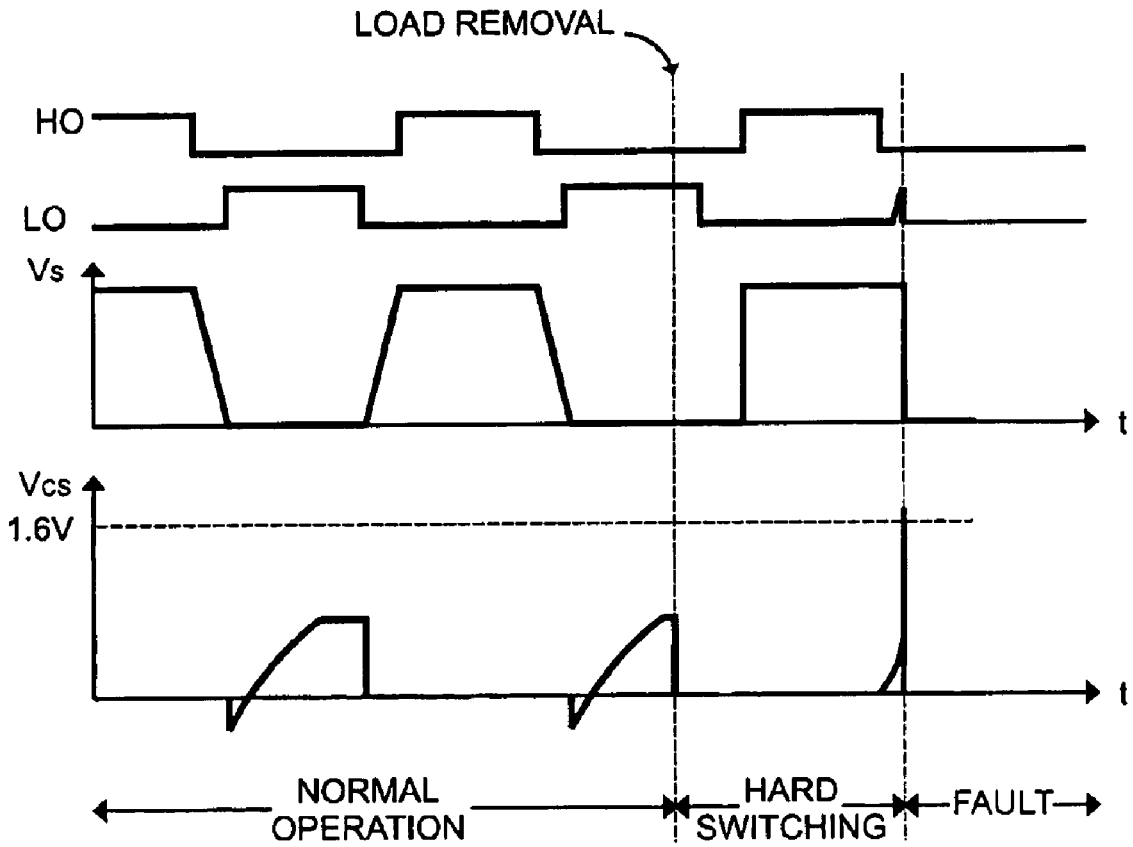
FIG. 20 is a set of timing diagrams illustrating fault detection and response.

Referring now to FIG. 20, a timing diagram illustrating hard switching detection is shown. During dimming mode, the peak current regulation circuit that is active during preheat and ignition is disabled. If non zero voltage switching occurs at the output of the switching half bridge composed of switches Q1 and Q2, high current spikes will result. A lamp filament failure, lamp end of life, lamp removal or a dead time shorter than that required for commutation can all cause hard switching. Accordingly, control IC 60 enters fault mode and the high and low side driver outputs HO and LO are both turned off if the peak voltage on pin CS exceeds 1.6 volts at any time during dimming mode. The fault mode can be reset by cycling the supply voltage on VCC below 10.9 volts or by the detection of greater than 2.0 volts on pin SD. Control IC 60 returns to preheat mode, as illustrated in state diagram 120 in FIG. 9.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An integrated circuit for control of an electronic ballast, comprising:

a current sense circuit for obtaining current measurements of current supplied by the electronic ballast;

a current reference for comparison with the current measurement obtained by the current sense circuit;

a first increased current reference established during an ignition phase of the electronic ballast to permit ignition at a higher current level than that determined by the current reference; and a second increased reference for establishing a threshold below which the current measurement falls after ignition.

2. The integrated circuit according to claim 1, further comprising:

an input control signal related to setting a power level for the electronic ballast; and an initial power level related to ignition in the electronic ballast and being greater than the control input power level setting, whereby the power level adjusts from the initial power level to the control input power level after ignition.

3. The integrated circuit according to claim 2, further comprising a rate of change circuit for controlling the adjustment of the power level from the initial power level to the control input power level.

4. An electronic ballast for a fluorescent lamp, comprising:

a current sense circuit for providing a current sense signal related to electronic ballast output current;

a reference signal for a comparison with the current sense signal to provide an indication of electronic ballast output current above a specified threshold related to the reference signal;

a reference signal adjustment circuit to modify the reference signal value to thereby modify the threshold for the electronic ballast current output determined by the current sense signal; and the reference signal being modified during ignition to obtain a higher threshold value and a corresponding higher electronic ballast current output value so that ignition occurs at a higher power level.

5. The electronic ballast according to claim 4, further comprising:

a control input signal for setting an output power level of the electronic ballast; and an initial power level setting related to ignition, the initial power setting being greater than the control input power level setting.

6. The electronic ballast according to claim 5, further comprising a rate of change control circuit for adjusting the electronic ballast power level from the initial power level to the control input power level according to a specified rate of change.

7. A method for flash suppression during ignition of a lamp with an electronic ballast, comprising:

measuring an output current of the electronic ballast;

setting a threshold value for a power level of the electronic ballast related to ignition of the lamp;

increasing the current level output of the electronic ballast to a value above the threshold level;

reducing the threshold level to a value less than the power output level of the electronic ballast after ignition of the lamp has occurred; and igniting the lamp and reducing the power output level of the electronic ballast below the reduced threshold.

8. The method according to claim 7, further comprising reducing the power level output of the electronic ballast to a value related to a control input setting.

9. The method according to claim 8, further comprising controlling the rate of change of the adjustments of the power level of the electronic ballast as the power level adjusts from the ignition power level to the power level associated with the control input setting.

* * * * *